United States Patent [19]

Powel et al.

[11] Patent Number: 4,907,758

[45] Date of Patent: Mar. 13, 1990

[54] COMPOSITE YARN CARRIER

[75] Inventors: Stephen S. Powel, 4305 Tallwood Dr., Greensboro, N.C. 27410; Robert J. Darby, 2517-A Patriot Way, Greensboro, N.C. 27408

[73] Assignees: Stephen S. Powel; Robert J. Darby, both of Greensboro, N.C.

[21] Appl. No.: 258,187

[22] Filed: Oct. 14, 1988

[51] Int. Cl.[4] ..... B65H 75/28

[52] U.S. Cl. ..... 242/125.1; 242/118.32; 242/165

[58] Field of Search ..... 242/125.1, 125, 125.2, 242/125.3, 118.3, 118.31, 118.32, 18 PW, 159, 164, 165, 166, 167, 176, 177, 178, 118.6, 118.62

[56] References Cited

U.S. PATENT DOCUMENTS

| | | | |
|---|---|---|---|
| 1,991,880 | 2/1935 | Chaffin | 206/64 |
| 2,837,292 | 6/1958 | Mass | 242/118.62 |
| 3,103,305 | 9/1963 | Heatherly | 242/125.1 X |
| 3,284,023 | 11/1966 | Sowell | 242/125.1 |
| 3,625,451 | 12/1971 | Anderson | 242/125.1 |
| 3,717,291 | 2/1973 | Adams et al. | 242/125.1 X |
| 3,794,260 | 2/1974 | Sowell | 242/125.1 |
| 3,971,526 | 7/1976 | Underwood | 242/118.6 |

FOREIGN PATENT DOCUMENTS 2463088 3/1981 France .

*Primary Examiner*—Stanley N. Gilreath
*Attorney, Agent, or Firm*—Rhodes, Coats & Bennett

[57] ABSTRACT

An end cap is releasably mounted on the end of a cylindrical hollow tube to form a reusable cylindrical yarn carrier or winding tube which carries a filamentary or fibrous yarn thereon. The end cap has a paper or wear resistant exterior surface and a rigid polymeric or metallic insert secured to and extending around the inner periphery thereof. The cylindrical hollow tube is formed of a cylindrical laminated paper outer surface and a rigid polymeric or metallic insert attached to the inner surface thereof adjacent at least one end. The rigid inserts carry threads that mate to releasably connect the end cap to the hollow tube. The abutting ends of the hollow tube and end cap, when assembled, define a peripheral starting groove therebetween. A minor portion of the peripheral groove is relatively narrow (locking portion), while the remaining major portion of the groove is wider (lead-in portion). When the yarn carrier has been emptied, the end cap is separated from the hollow tube and the residual fibers or filaments vacuumed or stripped away.

14 Claims, 3 Drawing Sheets

FIG. 1
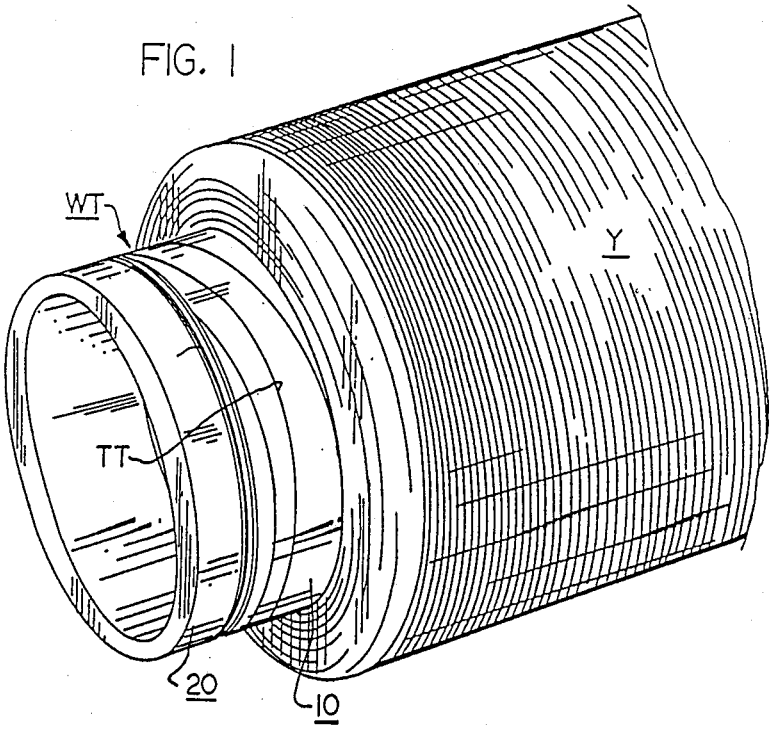
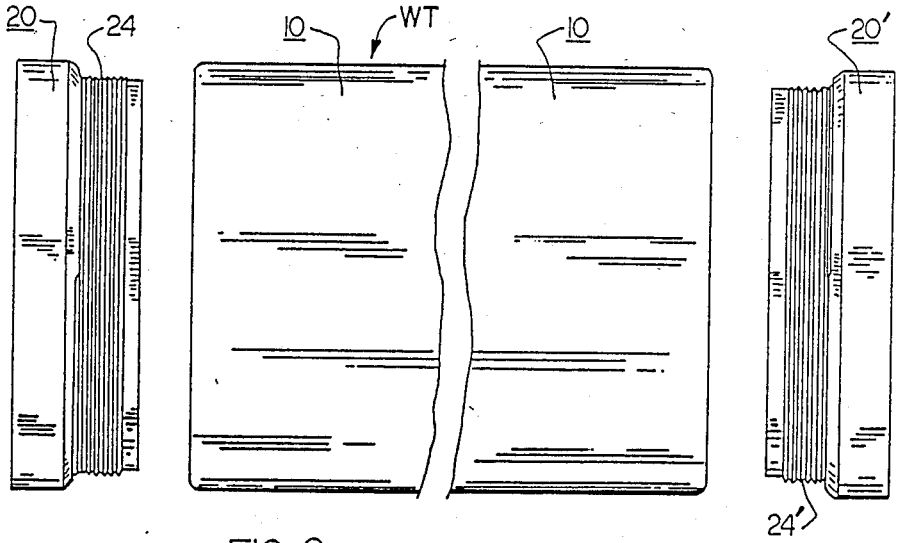
FIG. 2

COMPOSITE YARN CARRIER

BACKGROUND AND SUMMARY OF THE PRESENT INVENTION

The present invention is directed to winding tubes, and more particularly to a reusable winding tube in which the fibers or filaments are more easily removed from the peripheral starting groove which carries the waste bunch once the package has been emptied.

In conventional automatic winding operations, yarn is wound onto a cylindrical laminated paper tube (hereinafter referred to a "paper tube"). One end of the paper tube includes a starting groove cut into the surface thereof (U.S. Pat. No. 3,103,305). The starting groove is divided into two arcuate portions. The greater arcuate portion (approximately 270° ) is wider and referred to as the lead-in portion, while the smaller (approximately 90° ) arcuate portion (locking portion) is narrower and locks one or more of the initial strands of yarn therein during the initial few turns of the automatic winding operation. These strands are hereinafter and commonly referred to as the "waste bunch." The completed yarn package is removed from the winding machine, and stored or shipped for further processing. During further processing, the yarn is then removed from the yarn carrier.

When the yarn is removed from the package, the last few strands of the waste bunch remain wedged in the lead-in and locking portions of the starting groove. Because of the construction of conventional paper tubes, it is very difficult to remove these remaining strands of fibrous or filamentary material. Previous attempts to remove these strands have included vacuum stripping, cutting of the strands, or a combination of both. Neither technique is satisfactory, because vacuum stripping simply does not remove all the fibrous or filamentary material. Cutting the bunch generally results in damage to the surface of the paper tube making it unsuitable for further use. Such damage occurs when the laminates of the paper tube are nicked, cut, or otherwise interrupted. Use of a damaged tube at high speeds then tends to result in delamination.

As a result, conventional paper winding tubes are generally to reusable. There have been some attempts to reuse the tubes at least once by providing a starting groove at each end of the tube. However, often the paper tube is otherwise damaged during the doffing and emplacement operations which substantially eliminates the reuse of the paper tubes. Conventional paper tubes are relatively expensive (25¢ to $1.00 apiece) and hundreds of thousands or even millions per year are used by typical yarn manufacturers. Thus the cost of non-reusable yarn carriers is extremely high.

Merely the replacement of paper tubes with a stronger material such as a polymeric material or aluminum is not an obvious solution. First, the proper configuration of the starting groove cannot be molded or machined satisfactorily in the wall of a polymeric or metallic tube. Secondly, merely a change of material does not solve the problems created by the necessity to clean the starting groove. It is still not easy to vacuum the fibers from the starting groove, and utilizing a knife will still damage the surface of the tube so that it cannot be reused. While the use of polymeric material or metallic material such as aluminum is a first step toward an improved tube, it has been found that some improved technique for cleaning of the starting groove is necessary in order to achieve a reusable winding tube.

Examples in the prior art of separable yarn carriers are illustrated in the U.S. Pat. Nos. to Chaffin No. 1,991,880; Moss No. 2,837,297; and Underwood No. 3,971,526. However, none of these yarn carriers are for high speed automatic winding operations or solve the problems attendant to the removal of residual fibers and filaments from a starting groove.

In our copending application, Ser. No. 200,939 filed May 31, 1988, the tube is formed entirely of a polymeric or metallic material in two separable parts, i.e. the main hollow tube portion and a removable end cap. A starting groove of unique shape is formed between the abutting end walls of the end cap and hollow tube to receive the waste bunch during the automatic winding operation. After the yarn package is emptied the end cap is removed or partially removed from the hollow tube portion, the fibers or filaments vacuumed or stripped away, and the end cap replaced. The yarn carrier is then ready for reuse. A French Pat. No. 2,463,088 to Viscosuisse, S.A. shows a somewhat related concept in which a paper tube has a friction fit (apparently plastic) slip-on ring releasably attached to the end thereof. The slip-on ring has resilient fingers that fit inside the paper tube and hold the two components in assembled relation.

While both of the separable yarn carriers identified hereinabove have desirable characteristics and suggest improvements that might solve the groove cleaning problem, they present new problems. The all polymeric or metallic tube represents a significant change from the industry accepted paper tube. Obviously, the dies and/or molds for such an approach are very expensive. Further, the industry strongly prefers paper tubes for two reasons. First, from the standpoint of safety, if a paper tube fails at high speeds, it merely delaminates and no damage to equipment or personnel occurs. However, if a polymeric or metallic tube should fail, a large number of brittle pieces are released which could be dangerous to personnel or equipment. Secondly, most yarn carriers are surface driven by engaging the end portions with drive means. The drive wheels are designed to be compatible with paper and tend to scar conventional polymeric and other surfaces with a result that they become prematured, worn and unusable.

The French patent (No. 2,463,088) is illustrative of a yarn carrier having a separable end cap or ring for facilitating removal of yarn from the starting groove in preparation for reuse. However, the end cap (apparently plastic) is not compatible with the startup friction generated by conventional drive wheels, and the resilient or spring fingers are not a satisfactory connecting technique to adequately hold the end cap and the hollow tube together. In addition, the paper hollow tube is not capable of being threaded on the inner surface to effect a more secure threaded connection between the end cap and paper tube.

In the broadest aspect of the present invention, a hollow paper tube and separable paper end cap forming a starting groove therebetween are each provided with a rigid insert of polymeric or metallic material. The inserts include mating surface configurations which selectively effect a secure attachment of the end cap to the tube, yet allow for selective separation of the end cap and hollow tube to remove loose fibers from the starting groove. Since the exposed surfaces of the resulting yarn carrier is all paper, and the only rigid material is the relatively small, underlying inserts, the safety concerns of the industry are fulfilled and the desirable paper surface is maintained.

In its more specific aspects the reusable winding carrier of the present invention includes a hollow, predominantly paper, tube having an outer, substantially cylindrical surface adapted to carry a filamentary or fibrous yarn thereon. The end cap includes an outer substantially cylindrical paper surface generally of the same radius as the outer surface of the hollow tube. The end cap and hollow tube are each provided with underlying inserts having mating threads or other attachment means for releasably mounting the end cap on at least one end of the hollow tube. It is possible that both ends of the hollow tube may include releasable end caps of the type described to further increase the life expectancy of the winding tube.

It should also be noted that while the end caps are preferably paper with a polymeric insert, an alternate construction could be all polymeric with a circumferential wear strip of a higher molecular weight material.

A peripheral starting groove is formed between the abutting ends of the hollow tube and end cap encircling the yarn carrier. The starting groove is formed with a relatively narrow locking portion extending around a portion preferably (approximately 90°) of the periphery of the tube and a relatively wider lead-in portion extending around the remaining portion of the periphery. The lead-in portion guides the first few turns of the waste bunch into the locking portion. The wider and narrower portions of the starting groove are formed by molding recesses into or chamfering one or both abutting ends of the hollow tube and/or end cap during the fabrication of the components.

It is therefore an object of the present invention to provide improvements in yarn carriers which make the tubes reusable by facilitating the cleaning of the starting groove.

It is another object of the present invention to provide a yarn carrier of the type described in which an end cap is releasably attached to the main body portion and forms a starting groove therebetween.

It is another object of the present invention to provide a yarn carrier of the type described in which the outer surface of at least the hollow tube is paper and the attachment means for joining the two are polymeric or metallic inserts which underlie the paper portion.

Other objects and a fuller understanding of the invention will become apparent upon reading the following detailed description of a preferred embodiment along with the accompanying drawings in which:

FIG. 1 is a perspective view illustrating a yarn package wound on a winding tube made in accordance with the present invention;

FIG. 2 is a side view, with parts broken away, illustrating the winding tube of the present invention;

DETAILED DESCRIPTION OF A PREFERRED EMBODIMENT

Figure 3:
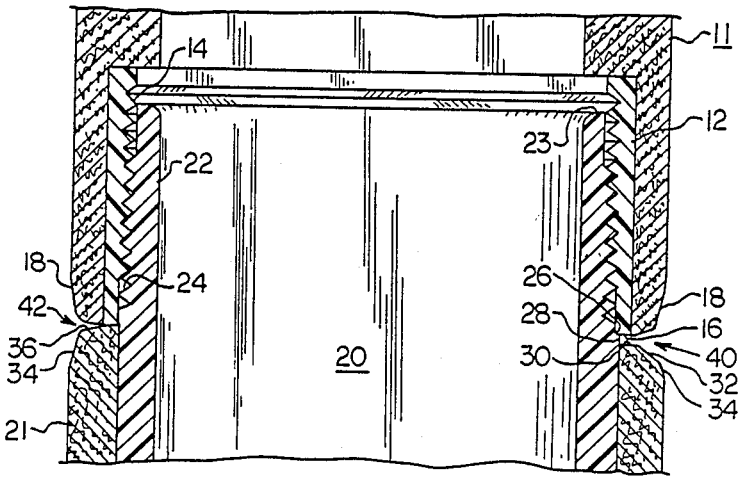
FIG. 3 is an enlarged sectional view taken diametrically through one end of the yarn carrier of FIG. 2.

Turning now to the drawings, and particularly to FIG. 1, there is illustrated a yarn package formed in accordance with conventional automatic winding techniques. The yarn package includes a winding tube WT about which thousands of turns of yarn Y are wrapped. The winding tube WT is formed of at least two parts, i.e. the cylindrical hollow tube 10 and at least one end cap 20. A starting groove extending around the periphery is formed between the hollow tube 10 and releasable end cap 20. As the yarn package is initially formed, a relatively small number of turns of the yarn are guided into the starting groove where they are locked and form the waste bunch (WB). The length of yarn extending between the waste bunch and the yarn package Y is referred hereinafter as the transfer tail TT.

An empty winding tube WT is initially emplaced on the spindle (not shown) of a winding machine ready to have yarn wound thereupon. During the automatic winding operation of polyester or any other extruded polymeric yarn thereon, a vacuum hose is receiving the continuous extrusion of polyester or other polymeric yarn filament through a spinneret awaiting the emplacement of the winding tube. The vacuum hose is then held near the bottom periphery of the winding tube WT while a hand-held wire instrument is used by the operator to lift or move the yarn filament into contact with the lead-in portion 40 of the starting groove. As the yarn is guided into the locking portion 42 of the starting groove, it latches up and breaks from the remainder of the yarn being carried away by the vacuum hose. After the break occurs, rotation of the winding tube causes a few turns to form a waste bunch in the starting groove. The waste bunch includes approximately one hundred or more turns. Formation of the waste bunch functions to lock the leading end of the yarn tail as well as to maintain the "off-spec" yarn out of the yarn package while the speed of the yarn being extruded and the rotation of the tube is stabilized. After the waste bunch is completed, the winder goes into a normal wind cycle with the yarn being wrapped around the main body of the hollow tube 10. Once the yarn package is emptied, the winding tube WT must either be discarded, or else the starting groove in which the waste bunch is wound must be cleaned of remaining fibers. While in conventional winding techniques, for all practical purposes the starting groove of a paper tube cannot be cleaned, in the present invention such cleaning is made possible and even facilitated.

Thus, in the present invention, once the winding tube WT is emptied, the end cap 20 is loosened from the hollow tube 10 (FIG. 2), whereupon the remaining fragments, filaments, or fibers of the waste bunch may be easily vacuumed or stripped away. The end cap 20 is then tightened, and the yarn carrier WT is ready for reuse.

Turning now to FIG. 2 there is illustrated an empty winding tube WT. A hollow cylindrical tube 10 is provided with a releasable end cap 20 on at least one end thereof. The periphery of tube 10 and end cap 20 are substantially coextensive. As illustrated in FIG. 2, a second end cap 20' may be releasably attached to the opposite end, in which case the life expectancy of the tube may be extended, and either end of the tube may serve to accumulate the waste bunch. However, it is felt that a quite satisfactory, long lasting winding tube WT can be fabricated which includes the end cap 20 on one end alone. The hollow tube 10 is formed predominantly of laminated paper or cardboard. An annular threaded insert or first ring 12 is attached to the end portion of hollow tube 10 as shown in FIG. 5. Insert 12 is formed of a more permanent material such as polymers selected from the group containing polycarbonate, PBT, PVC, ABS, polytetraphthalate, glass filled polymers, and carbon filled polymers. The inserts may even be formed of aluminum, magnesium, or some other lightweight metallic material. The end caps 20 (FIG. 4) include an outer cylindrical laminated paper member 21 substantially coextensive with the outer surface of tube 10. A second insert or ring 22 is bonded or secured to the inner surface of the paper member 21 and is formed of one of the same materials as the first insert or ring 12.

Figure 4:
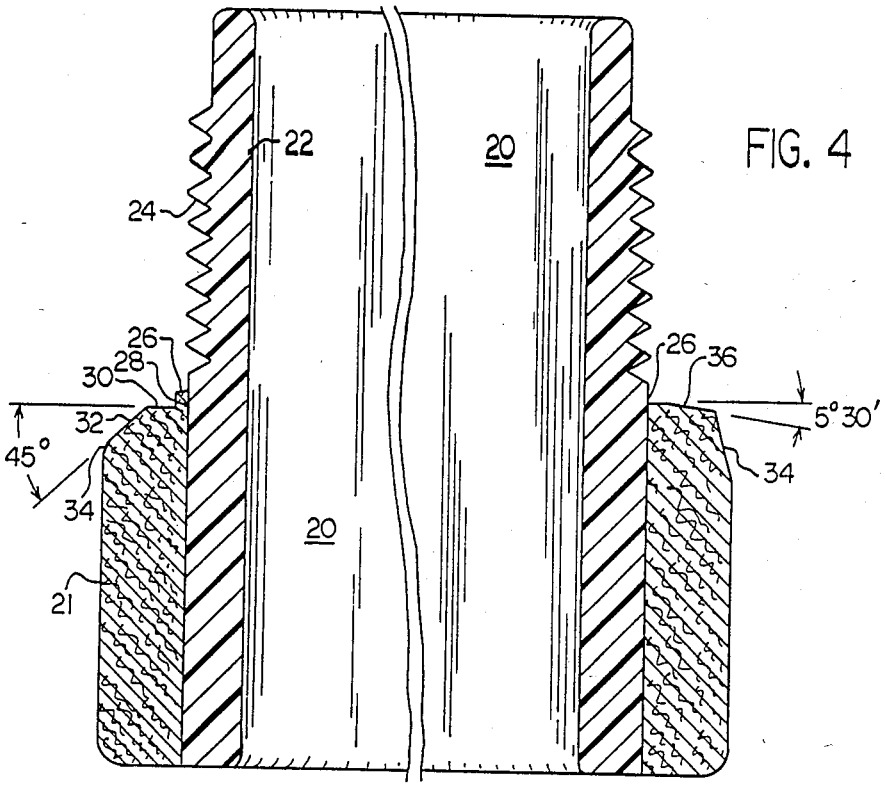
FIG. 4 is a greatly enlarged sectional view of the end cap removed from the cylindrical portion of the winding tube.
Figure 5:
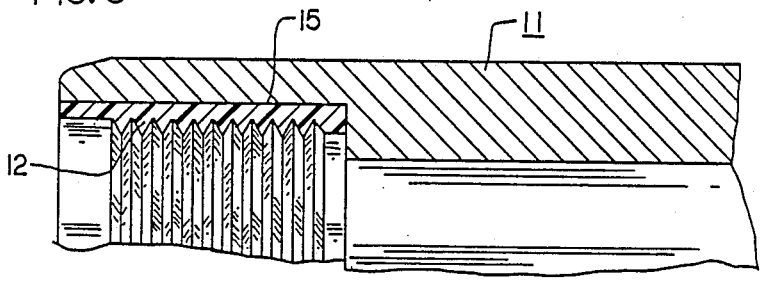
FIG. 5 is an enlarged sectional view of an end portion of the winding tube.

Looking at FIGS. 3–5, the relationship between the end cap 20 and hollow tube 10 is best shown as a result of the enlarged illustrations. The hollow tube 10 includes a marginal or terminal portion 11 having reduced wall thickness. The insert 12 includes internal threads 14 extending peripherally around the interior wall thereof. Hollow tube 10 terminates in an end wall 16 at which terminate both the first insert 12 and the terminal end of marginal portion 11. A tapered or chamfered surface 18 joins the outer periphery of hollow tube 10 and the end wall 16 to guide yarn being wrapped around hollow tube 10 in the area of the end portion thereof inwardly toward the peripheral groove portions 40,42. A seat or counterbore 15 is formed in the inner surface of hollow tube 10 adjacent the terminal end thereof. Insert 12 is secured within seat 15 by a suitable adhesive such as methylene chloride. The seat may be formed. by machining a counterbore in a paper tube; or by manufacturing the paper tube with an integrally formed seat 15.

The end cap 20 includes an outer cylindrical laminated paper member 21 with an axially extending second insert 22 of reduced wall thickness and having outer threads 24 around the periphery thereof which mate with and engage the inner threads 14 of first insert 12. The mating threads 14,24 form a means for releasably mounting the end cap 20 onto the hollow tube 10. Alternate mounting means might include snap fits or bayonet tabs or the like, it being understood that the mating threads 14,24 are representative thereof. Immediately adjacent the base of threads 24 on end cap 20 is a radially extending peripheral rim 26 formed around the inner periphery of paper member 21, which forms a stop against which the end wall 16 of the hollow tube 10 engages as the end cap is mounted on the hollow tube 10. The marginal or end portion 11 of hollow tube 10 is longer than the distance between the end of insert 22 and rim 26, so that the end wall 16 will engage peripheral rim 26 prior to the time the terminal wall 23 of the end cap 20 engages the corresponding portion of hollow tube 10.

A shoulder 28 extends around approximately three-fourths of the periphery of the end cap 20 (approximately 270°) and separates the peripheral rim 26 from a second or groove forming wall 30. The shoulder 28 maintains a separation (approximately 0.022 inches) between the end wall 16 of hollow tube 10 and the second groove forming wall 30 which separation is substantially greater than the diameter of the yarn being wound thereon. The separation between end wall 16 and wall 30 forms the lead-in position 40 of the starting groove. A bevelled surface or first chamfer 32 (approximately 45° ) angles outwardly from the groove forming wall 30 toward the outer periphery of the end cap 20. Finally a slight chamfer 34 connects the outer periphery of end cap 20 with the first chamfer 32.

In the remaining one-fourth (approximately 90°) of the periphery of the end cap, the shoulder 28 and groove forming wall 30 is replaced by the slightly angled peripheral rim 36 which, with end wall 16, for the locking portion 42. Rim 36 does not extend radially, rather is tapered away from an imaginary radius by an angle of approximately 5° 30 min. Again the second rim 36 is connected to the outer periphery of end cap 20 by a chamfered surface 34 to guide yarn into the starting groove area.

Figure 6:
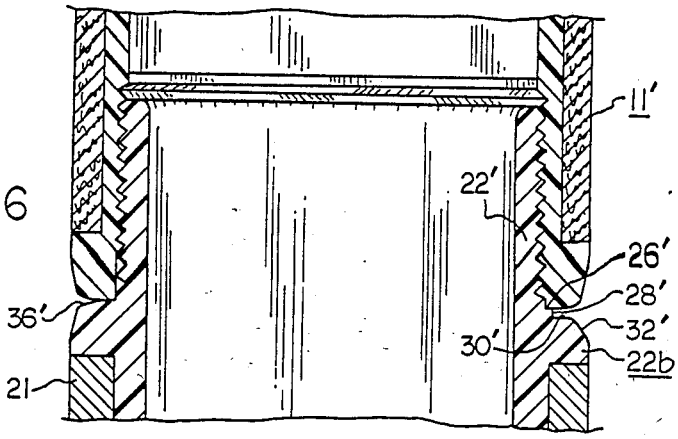
FIG. 6 is a view similar to FIG. 3, except showing an alternate embodiment of the end cap.

In FIG. 6, there is illustrated an alternate embodiment in which the end cap and adjacent end of the winding tube are so formed that the abutting surfaces are all polymeric. Thus an abutment 11*b* on winding tube 11' and an abutment **22*b* have the facing edges molded therein. According to this approach, the rim 26', shoulder 28', groove forming wall 30', bevel surface 32', and slightly angled peripheral rim 36' are all formed as part of the polymeric insert 22' rather than as a part of the paper member 21. It is believed than as a part of the paper member 21**. It that forming these surfaces into the polymeric insert rather than the paper insert may result in a superior product.

Figure 7:
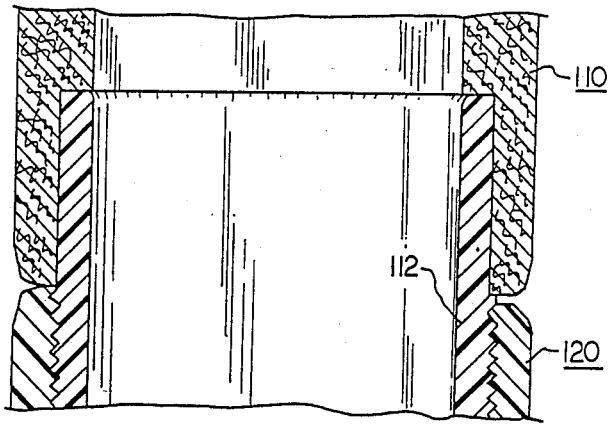
FIG. 7 is a view similar to FIGS. 3 and 6, except showing a second alternate embodiment of the end cap

In another alternate embodiment (FIG. 7), the end cap is all polymeric being formed of a wear resistant material that is capable of withstanding the frictional forces exerted by the drive wheels against the surface thereof without damage thereto. For some reason, paper can resist these forces with only minimal damage, but most polymers exhibit unacceptably high wear. One example of a polymer which apparently exhibits the necessary wear characteristics is high density, ultra high molecular weight polyethylene having an average molecular weight of 3.54 million as measured by the light scattering method. In this embodiment, the end cap 120 includes internal threads and the tube 110 includes an insert 112 that extends axially beyond the tube, is externally threaded, and is received within end cap 120. This construction is more cost efficient.

Thus formed, there is a transfer groove means formed between the abutting ends of the hollow tube and the end cap which encircles the yarn carrier. The groove means includes first a relatively wide lead-in portion 40 which is formed by shoulder 28 and which extends approximately 270° around the periphery of the winding tube WT. Secondly a relatively narrow locking portion 42 is formed between the abutting end 16 of cap 26. So arranged, the yarns of the waste bunch are directed toward the lead-in portion 40 and into the locking portion 42 as the winding tube is rotated.

When the yarn package is emptied, yarn fibers and filaments tend to remain in the lead-in portion 40 and the locking portion 42. Such yarn ends cannot be vacuumed or stripped away in conventional, integrally formed paper tubes. However, the present construction allows the operator to release and move the end cap in an axial direction away from the end of the winding tube, whereupon the fibers and filaments are released and can be easily removed by suction or other stripping techniques.

As suggested earlier, the separable end cap and starting groove configuration may appear at both ends of the winding tube, if desired. While the invention has been described in detail hereinabove, it is obvious that various changes and modifications might be made without departing from the scope of the invention which is set forth in the accompanying claims.

What is claimed is:

1. A reusable yarn carrier comprising:

(a) a composite hollow tube having an outer, substantially cylindrical laminated paper surface adapted to carry a fibrous or filamentary yarn thereon, an annular, first ring secured to the end portion of the inner surface of said hollow tube, said ring being formed of a rigid material relative to said paper;

(b) a separable end cap having an outer cylindrical surface formed of a wear-resistant material that can withstand the forces exerted by a surface drive mechanism of automatic winding machines, said separable end cap including an annular, second ring means associated therewith;

(c) said first ring and second ring means being joined by mating attachment means for releasably mounting said end cap on at least one end of said hollow tube;

(d) abutting walls of said tube and end cap defining a starting groove therebetween encircling said yarn carrier, said starting groove comprising a relatively narrow locking portion extending partially around said periphery and a relatively wider lead-in portion around the remainder of said periphery;

(e) whereby the lead-in portion guides the first few turns of a waste bunch into the locking portion and said abutting walls of said tube and end cap of said yarn carrier are separable to loosen trapped fibers and facilitate cleaning and reuse.

2. The yarn carrier according to claim 1 wherein the outer cylindrical portion of said end cap is laminated paper and said second ring is secured to the inner surface thereof.

3. The yarn carrier according to claim 1 wherein said mating attachment means are threads.

4. The yarn carrier according to claim 3 wherein said threads are formed internally of said first ring and externally of said second ring.

5. The yarn carrier according to claim 1 wherein slid first and second rings are formed of a polymeric material.

6. The yarn carrier according to claim 5 wherein lid polymeric material is polycarbonate.

7. The yarn carrier according to claim 1 wherein said first ring and said second ring means are formed of a metallic material selected from the group consisting of aluminum and magnesium.

8. The yarn carrier according to claim 1 wherein one of said end caps is provided on each end of said hollow tube.

9. The yarn carrier according to claim 1 wherein said starting groove comprises a lead-in portion and a locking portion, said lead-in portion extending approximately 270° around the periphery of said tube and said locking portion extending approximately 90° around the periphery of said tube.

10. The yarn carrier according to claim 9 wherein said lead-in portion is formed by a shoulder separating the abutting walls of said hollow tube and said end cap, and said locking portion is formed by one of the abutting walls of said hollow tube and said end cap being tapered from an imaginary radius.

11. The yarn carrier according to claim 10 wherein said lead-in groove has a width greater than the diameter of the yarns being wound thereon.

12. The yarn carrier of claim 1 in which the first ring includes an abutment extending radially therefrom and confronts said end cap, and said second ring includes an abutment extending radially therefrom, said starting groove being defined by said abutments of said first and second rings.

13. The yarn carrier according to claim 1 wherein said end cap is all polymeric material.

14. The yarn carrier according to claim 13 wherein said material is ultra high molecular weight polyethylene.

* * * * *